United States Patent [19]

Natterer et al.

[11] Patent Number: 4,601,421

[45] Date of Patent: Jul. 22, 1986

[54] FEEDING MEANS FOR FEEDING A MATERIAL WEB IN A PACKAGING MACHINE

[75] Inventors: Johann Natterer, Legau; Ivo Ruzic, Kempten, both of Fed. Rep. of Germany

[73] Assignee: Multivac Sepp Haggenmuller KG, Fed. Rep. of Germany

[21] Appl. No.: 596,238

[22] Filed: Apr. 2, 1984

[30] Foreign Application Priority Data

Apr. 28, 1983 [DE] Fed. Rep. of Germany ..... 3315419

[51] Int. Cl.[4] ..... B65H 17/34

[52] U.S. Cl. ..... 226/173; 226/75; 198/626

[58] Field of Search ..... 226/170, 171, 172, 173, 226/74, 75; 198/626, 627, 628, 694, 695, 696, 850, 851, 852, 853

[56] References Cited

U.S. PATENT DOCUMENTS

| | | | |
|---|---|---|---|
| 969,295 | 9/1910 | Meahl | 226/173 |
| 2,237,877 | 4/1941 | Fulk | 226/173 X |
| 3,726,389 | 4/1973 | Klein et al. | 198/695 |
| 3,773,235 | 11/1973 | Canamero et al. | 226/173 X |
| 4,397,411 | 8/1983 | Vetter | 226/173 |

*Primary Examiner*—Harvey C. Hornsby
*Attorney, Agent, or Firm*—Donald Brown

[57] ABSTRACT

A feeding means for feeding a material web in a packaging machine comprises feeding chains, sprocket wheels and an engagement element for feeding the feeding chains. In order to facilitate the insertion and clamping of the material web the engagement member is designed such that in a first portion of the travelling section the movable clamping member is lifted from the fixed clamping member in a substantially vertical direction and in a second portion of the travelling section following the first portion the movable clamping member is additionally moved laterally away from the edge of the material web to be gripped.

10 Claims, 9 Drawing Figures

FEEDING MEANS FOR FEEDING A MATERIAL WEB IN A PACKAGING MACHINE

BACKGROUND OF THE INVENTION

The invention relates to feeding means for feeding a material web from an inlet side to an outlet side in a packaging machine comprising feeding chains disposed on both sides of the web and sprocket wheels for feeding the feeding chains, each feeding chain having chain links and clamps connected therewith for clamping the material web with a fixed clamping member connected with the associated chain link and a movable clamping member, and a compression spring for biasing the movable clamping member into the closed position, and an engagement element being adapted to engage the movable clamping member along a distance traversed by the chain.

A feeding means of that kind is known from the DE-OS No. 22 24 854. The fixed clamping members are rigidly connected with sleeves slidably guiding therein a bolt rigidly connected with the movable clamping members such that an inclination of the bolt and thus of the movable clamping member is avoided.

The AT-PS No. 31 64 28 shows a feeding chain having lateral angular butt straps attached to the chain links, wherein the lateral angular butt straps comprise horizontal bolts engaging slots provided at the movable clamping member. The engagement members cooperating with a feeding chain of that kind and being designed as engagement discs comprise pocket-like recesses cooperating with the chain links such that the movable clamping members are lifted and lowered in an inclined direction. Thus the clamping jaw of the movable clamping member is not vertically lowered onto the clamping jaw of the fixed clamping member and may thereby cause a displacement of the material web when the clamp is closed. Furthermore, the structure of the chain links as well as the one of the engagement disc is intricate.

OBJECTS OF THE INVENTION

It is a principal object of the invention to provide an improved feeding means of the above kind. It is a further object of the invention to provide feeding means allowing the edges of the material web to be securely gripped by the clamps without causing difficulties in feeding the web to the clamps, even if the width of the material web is not accurately constant. It is a further object of the invention to provide a feeding means avoiding the displacing of the material web towards the middle of the packaging machine when gripping the material web.

SUMMARY OF THE INVENTION

In accordance to the invention the feeding means comprises an engagement element adapted to engage the movable clamping member along a travelling section of the chain, wherein the engagement element is designed such that in a first portion of the travelling section the movable clamping member is lifted from the fixed clamping member in a substantially vertical direction and in a second portion of the travelling section following the first portion the movable clamping member is additionally moved laterally away from the edge of the material web to be gripped.

BRIEF DESCRIPTION OF THE DRAWINGS

The invention is hereinafter more particularly described with reference to embodiments shown in the accompanying drawings. In the drawings.

Figure 1:
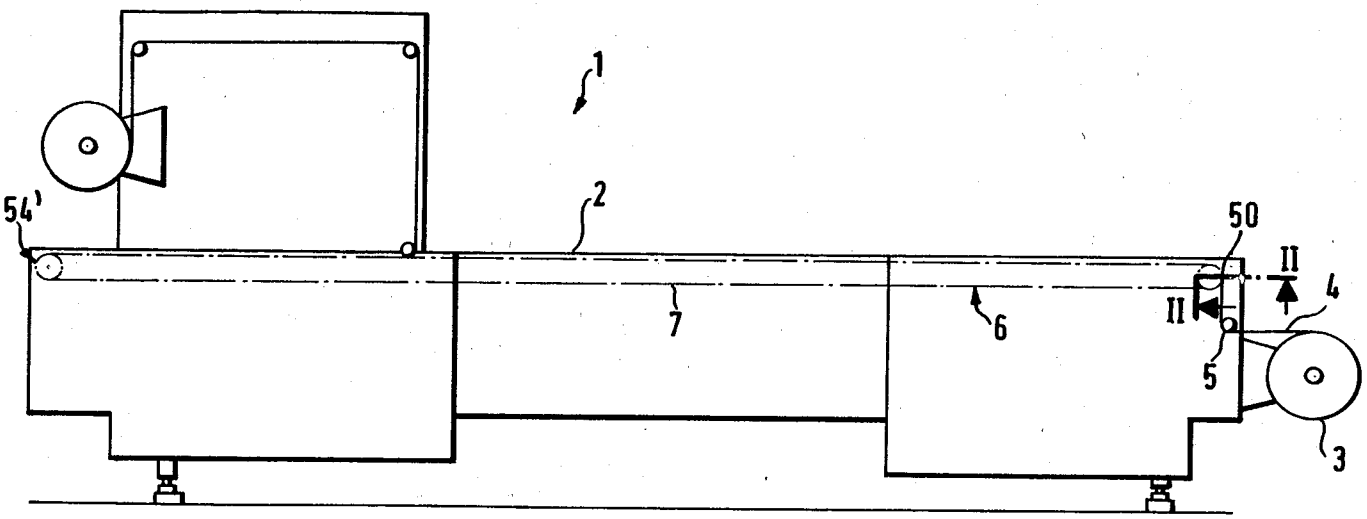
FIG. 1 is a lateral view of a packaging machine with feeding means in schematic representation.

The invention may in particular be applied to a deep-drawing packaging machine, which is generally denoted with reference number 1 in FIG. 1. This packaging machine comprises a machine frame 2 having an inlet side where a reel 3 with foil material is disposed, the material web 4 being drawn off from this foil material and being fed over a guide roller 5 to a feeding means 6.

The feeding means 6 in a known manner comprises endless strands of chain 7 being fed over and driven by sprocket wheels at their return points. In a known manner clamps for laterally clamping the material web 4 and for feeding the web through the processing stations of the deep-drawing packaging machine are mounted to the chain links. At the outlet side the material web is released from the clamps.

Figure 2:
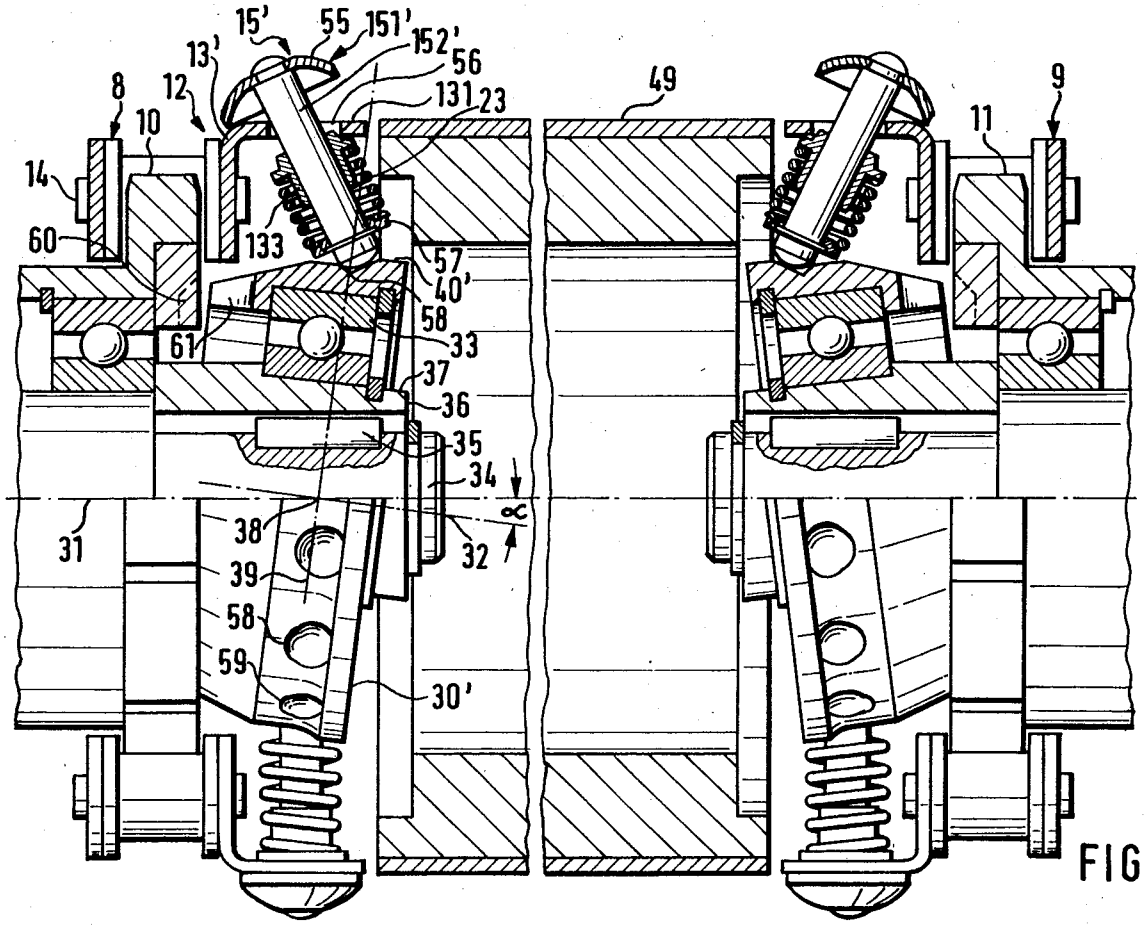
FIG. 2 is a sectional view of a part of a first embodiment of the inventive packaging machine, along line II—II in FIG. 1.

As may be best seen from FIG. 2 the feeding chains 8, 9 run on sprocket wheels 10, 11 being in a known manner supported in the machine frame 2 by means of roller bearings and shafts. The left and right strand of chain with the associated drive means are symmetrically designed. Hence only one side is further described.

Figure 3:
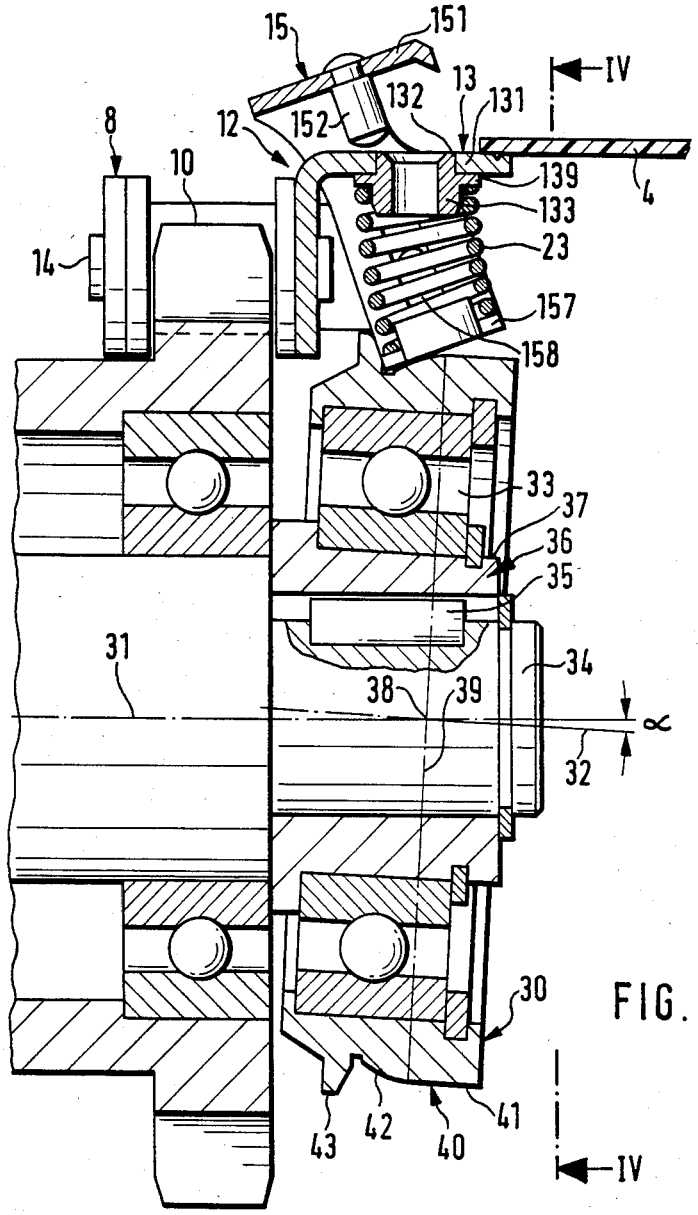
FIG. 3 is a partial representation of a second embodiment corresponding to the left half of the representation shown in FIG. 2, along line III—III in FIG. IV.
Figure 4:
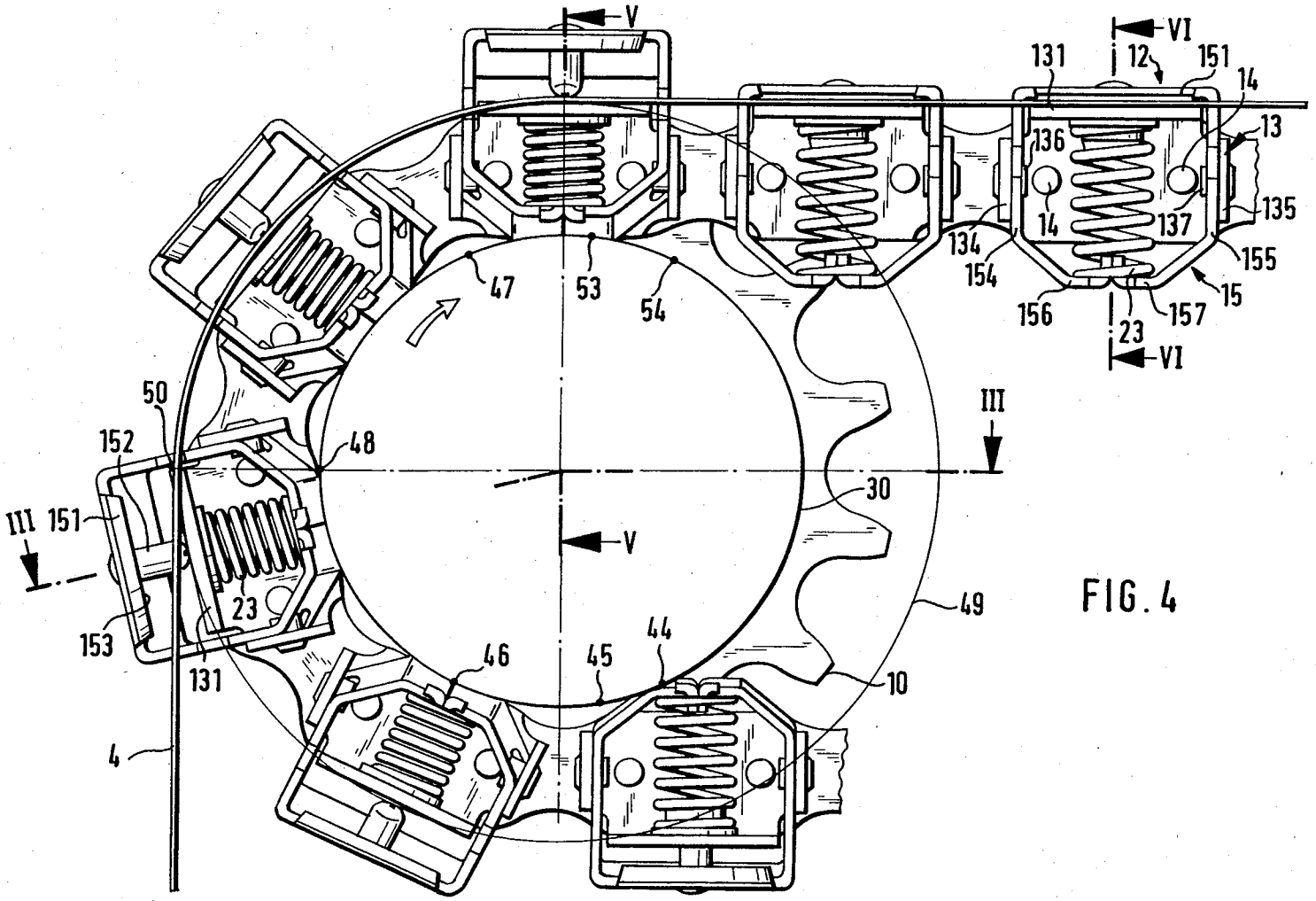
FIG. 4 is a lateral view of the feeding chain with engagement disc in the direction of arrows IV—II in FIG. 3, turned by 90°.
Figure 5:
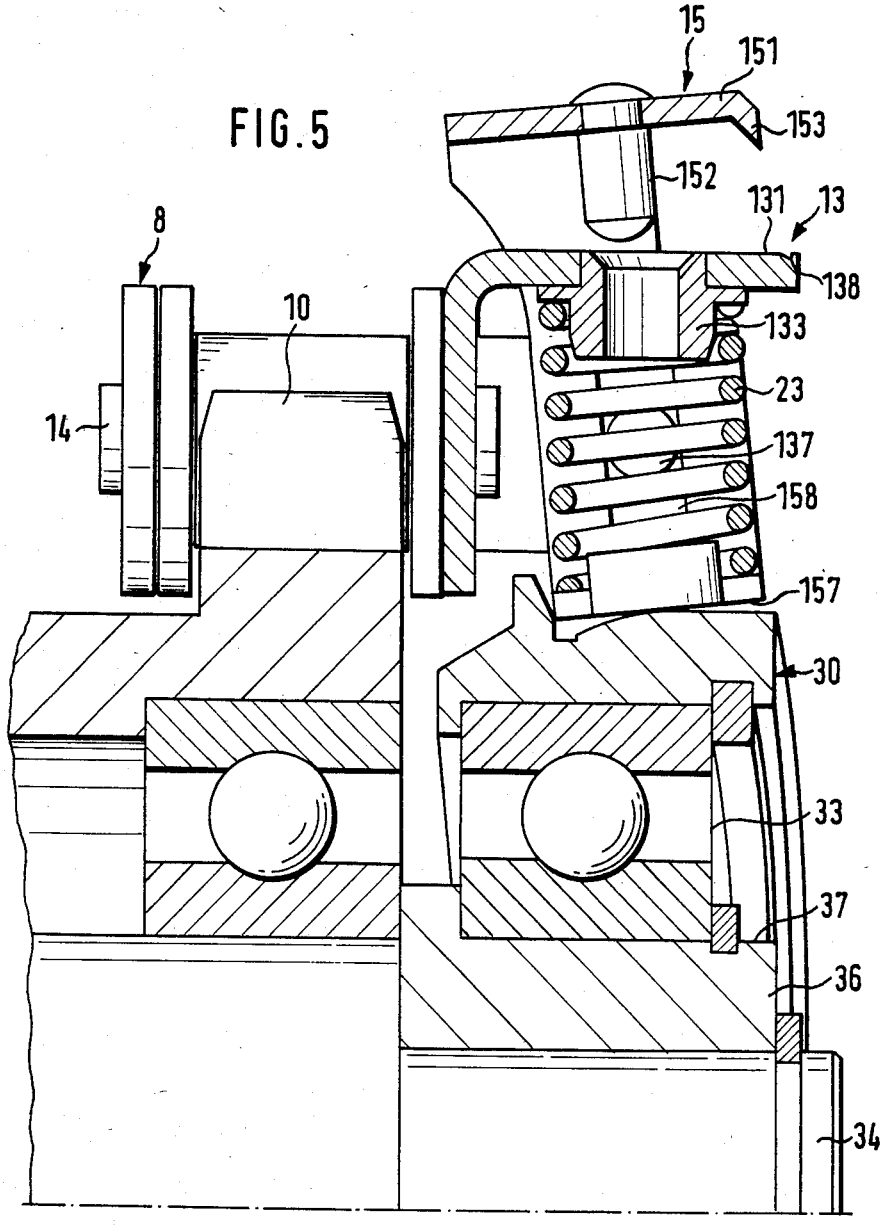
FIG. 5 is a sectional view along line V—V in FIG. 4.

To begin with the embodiment shown in the FIGS. 3–5 is described in the following. In this embodiment each chain link comprises a clamp 12. This clamp comprises a fixed clamping member 13 in the form of an angular butt strap riveted to the bolt 14 of the chain link. Furthermore there is provided a movable clamping member 15 being designed in form of a box-like clamp with a movable clamping jaw 151, lateral walls 154, 155 and lower bent-over supports 156, 157. The fixed clamping member 13 comprises a fixed clamping jaw 131 with a bore 132. A flange sleeve 133 is provided coaxially with this bore at the underside of the fixed clamping jaw 131, the flange sleeve being rigidly connected with the clamping jaw. A compression spring 23 biasing the movable clamping jaw 151 into the closed position is provided between the flange 139 of the flange sleeve and the lower legs of the movable clamping member forming the supports 156, 157.

The movable clamping jaw 151 comprises an edge 153 FIG. 5 disposed at the end thereof turned away from the chain, the edge engaging into a notch 138 provided at the fixed clamping jaw 131 in the closed position.

A fixing bolt 152 being rigidly riveted to the movable clamping jaw is provided at the underside of the upper part of the movable clamping jaw facing the fixed clamping jaw, the fixing bolt being arranged such that in the closed state of the clamp the fixing bolt is aligned coaxially with the flange sleeve 133 and that its outer diameter is selected such that the bolt may slide within the flange sleeve. Its length is selected such that it is first guided a distance within the flange sleeve and thereafter emerges therefrom.

The fixed clamping member 13 comprises two lateral parts 134, 135 in the form of flaps bent forwardly substantially at a right angle. Guide pins 136, 137 are riveted into the respective flaps. The movable clamping member 15 comprises oblong holes 158 FIG. 5 in the side walls 154, 155 thereof. The oblong holes 158 extend parallel to the direction of the bolt 152. The bolt-shaped designed guide pins 136, 137 are received by the adjacent oblong holes 158.

Figure 6:
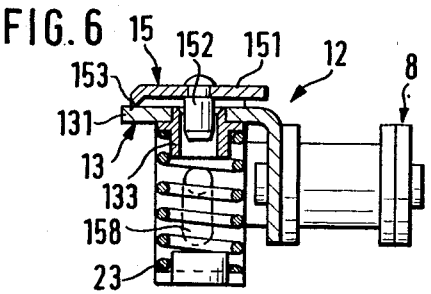
FIG. 6 is a sectional view of a closed clamp according to the second embodiment, along line VI—VI in FIG. 4.

FIG. 6 shows a section through a closed clamp according to the embodiment shown in the FIGS. 3–5. In this closed state the movable clamping jaw 151 with the edge 153 is pressed towards the fixed clamping jaw 131 by means of the compression spring 23. Thereby the bolt 152 is moved into the flange sleeve 133 to a certain extent. It may be seen from FIG. 6 that in lifting or lowering the movable clamping member 15 this is moved in a direction perpendicular to the fixed clamping jaw 131 as long as the bolt 152 is guided in the flange sleeve 133.

An engagement disc 30 FIG. 5 is provided adjacent to the sprocket wheel, the engagement disc being disposed between the clamps returned around the sprocket wheel axis and serving for opening the clamping jaws for insertion and clamping and releasing, respectively, of the material web 4 to be fed. The engagement disc 30 is disposed concentrically with the sprocket wheel axis 31. The axis 32 of the engagement disc forms and angle $\alpha$ FIGS. 2 and 3 with the sprocket wheel axis 31. The engagement disc 30 is rotatably supported by means of a ball bearing 33. The sprocket wheel 10 and the engagement disc 30 are both supported on a common sprocket wheel shaft 34. In order to incline the engagement disc 30 a boss 36 is provided being keyed to the sprocket wheel shaft 34 by means of a wedge 35 in FIG. 3 and having a journal 37. The axis of the journal 37 coincides with the axis 32 of the engagement disc and forms an angle $\alpha$ with the boss axis coinciding with the sprocket wheel axis 31. The axis of the journal is pivoted about the angle $\alpha$ in a point 38 defined as the point of intersection of a line of intersection 39 passing the middle of the engagement surface and the sprocket wheel axis 31. The position of the engagement disc 30 may be adjusted by adjusting the rotational position of the boss 36 and the sprocket wheel shaft 34, respectively, with respect to the sprocket wheel axis 31.

The engagement disc 30 comprises an engagement surface 40 having, as may be best seen from FIG. 3, a plane section 41 at the side thereof facing the material web 4 to be clamped, the plane section extending from the outer edge of the engagement disc facing the material web to the line of intersection 39. This section is followed by a convex section 42 being defined by a projecting guide flange 43.

The clamp 12 is opened by engagement thereof with the engagement disc 30 at point 44 (FIG. 4). By guiding the bolt 152 in the flange sleeve 133 and the guide pins 136, 137 in the oblong holes 158 the movable clamping member 15 is lifted vertically until the bolt 152 emerges from the flange sleeve 133 about at point 45. At this point the convex section is brought into engagement with the supports 156, 157, as shown in FIG. 5, due to the inclined engagement disc 30. Now, i.e. after lifting the movable clamping member, a tilting action is started due to the increasing distance of the engagement surface 40 from the sprocket wheel 10 because of the inclination of the engagement disc 30. During this tilting action the movable clamping member is tilted through the position shown in FIG. 5 into the position shown in FIG. 3 riding on the convex section and being guided by the guide flange 43. Thus the width of the convex section 42 is selected such that starting from point 45 the movable clamping member 15 steadily swings further outwardly into the inclined position shown in FIG. 3 forceably guided by the convex section moving away from the sprocket wheel 10 and the guide flange 43. At point 46 the clamp is totally opened and remains in the opened position until point 47. The maximal lateral displacement is reached at point 48.

As may be best seen from FIG. 2 a guide drum 49 for deflecting the material web 4 drawn from the supply reel 3 is freely rotatably supported between the opposed sprocket wheels 10, 11. The position of the engagement disc 30 is adjusted such that the maximum distance of the engagement surface 40 from the adjacent sprocket wheel 10 is reached at the angular position corresponding to point 48, lying on that radius intersecting the rotational axis of the engagement disc and the guide drum on which also point 50 is positioned, where the material web 4 meets the guide drum 49. In the embodiment shown in FIG. 1 this point 50 lies on a horizontal line passing through the mentioned center. It is thus achieved that at the inlet point of the material web the movable clamping jaw 151 cooperating with the fixed clamping jaw 131 formed as horizontal leg is swung out to such an extent that the material web 4 may be inserted and guided onto the fixed clamping jaw 131 without a contact of the material web 4 with the movable clamping jaw 151. After turning further beyond point 48 the movable clamping member 15 first swings back into the vertical position until point 53. At point 53 the bolt 152 enters the flange sleeve 133, which is followed by a vertical backward movement of the movable clamping member into the closed start position, wherein the movable clamping jaw firmly clamps the material web 4 in cooperation with the fixed clamping jaw 131. At point 54 the closed end position is reached. At the outlet side 54' both engagement discs are correspondingly designed such that there the opening and closing operation is performed in a corresponding manner and the material web is released.

In the first embodiment shown in FIG. 2 the features corresponding to the above described embodiment are characterized by the same reference numerals. Again both sides are designed symmetrical with each other and thus only one side is described.

The fixed clamping member 13' is designed as an angle piece having a vertical leg being connected with the chain link by means of the bolt 14 and a horizontally fixed clamping jaw 131. The fixed clamping jaw comprises a bore 56. The movable clamping member 15' comprises a fixing bolt 152' being provided at its end turned away from the engaging disc 30' with a movable clamping jaw 151' designed as a head riveted thereon and designed as a mushroom or sperical segment. In the closed state the movable clamping jaw 151 clamps and holds a material web in cooperation with the fixed clamping jaw 131. The bolt 152' has a ring 57 on its side turned away from the head and close to its other end. Differing from the first embodiment the flange sleeve 133 is not rigidly connected with the fixed clamping jaw 131. The compression spring 23 is provided between the flange sleeve 133 and the ring 57, one end thereof resting against the flange sleeve 133 and the other end against the ring 57, and biases the movable clamping member 13' into the closed position.

The engaging disc 30' is supported in a manner similar to that of the above described embodiment. The engagement surface 40', however, differs from the above embodiment. The engagement disc comprises centering bores 58 which in the embodiment shown are formed as blind bores. The centering bores 58 are arranged on a circumferential line in a circumferentially staggered manner. Their angular distance corresponds to the angular distance of the clamps 12 fed around the sprocket wheel. The engaging disc 30' comprises a plurality of circumferentially staggered recesses 61 on the side facing the sprocket wheel 10. The sprocket wheel 10 comprises a corresponding plurality of projecting portions 60 on its side 59 facing the engagement disc 30, the projecting portions being formed such that they may be brought into engagement with an adjacent recess 61. The projecting portions 60 are arranged such that they come into engagement in the region where the engagement disc and the sprocket wheel are closer adjacent to each other.

The centering bores 58 are circumferentially distributed such that in a direction parallel to the axis 31 a centering bore 58 is associated to a respective clamp. The centering bores take over the guiding of the respective bolts in that way that these engage with the associated bores and are guided and retained therein. The lateral dislocation is performed by the side wall of the centering bore which corresponds to the guide flange 43 of the first described embodiment.

Figure 8:
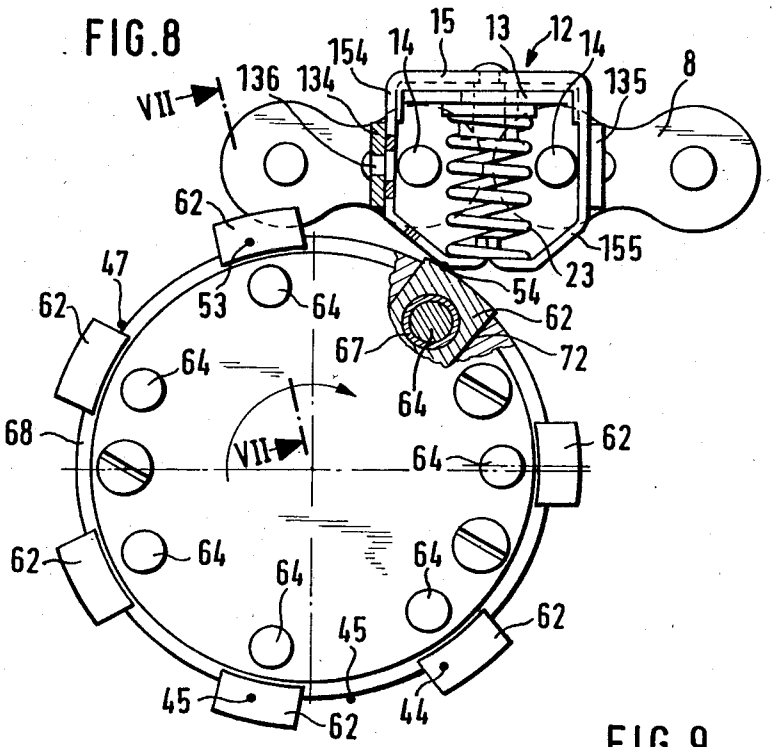
FIG. 8 is a lateral view of the feeding means according to the third embodiment in the direction of arrows VIII—VIII in FIG. 7.
Figure 7:
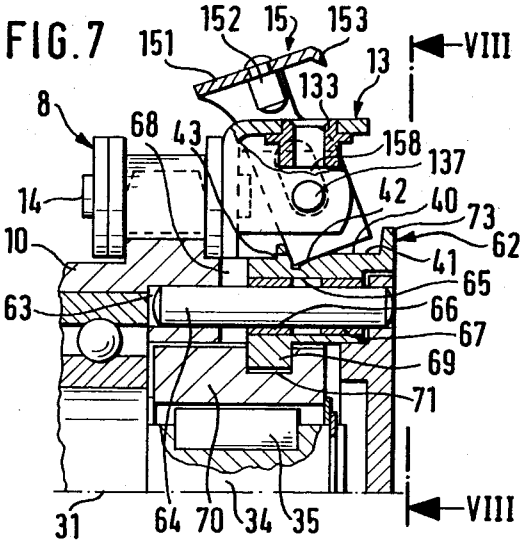
FIG. 7 is a partial representation of a third embodiment corresponding to the representation shown in FIG. 3, along line VII—VII in FIG. 8.

A third embodiment of the invention is shown in the FIGS. 7 and 8. Parts corresponding to those of the above embodiments are denoted with the same reference numerals. The embodiment of FIGS. 7 and 8 differs from the second embodiment according to the FIGS. 3–5 in particular in that a plurality of sliders 62 movable with the sprocket wheel 10 and each corresponding with respect to its function to a part of the engagement surface 40 are provided in place of the engagement disc 30. The sliders 62 are disposed at the inner front side of the sprocket wheel 10 with equal distance from the sprocket wheel axis in such a position and such a distance from each other that the outer surface of the sliders 62 forming the engagement surface 40 comes into engagement with the movable clamping members 15 of the clamps 12 fed with the chain. The distance of the engagement surface 40 from the sprocket wheel axis is equal to the distance of the engagement surface 40 of the engagement disc 30 from the axis 32 thereof. In a manner similar to the engagement surface of the engagement disc 30 the engagement surface of the sliders 62 comprises a plane section 41 and a convex section 42 which is defined by a projecting guide flange 43. Additionally the engagement surface 40 of the sliders 62 is defined by a second guide flange 73 on the side turned away from the sprocket wheel 10.

In order to support the sliders 62 fitting bores 63 arranged circularly around the sprocket wheel axis 31 are provided at the inner front side of the sprocket wheel 10 and guide pins 64 arranged parallel to the sprocket wheel axis 31 are inserted into the fitting bores 63. On each of the guide pins 64 a slider is supported slidably in the direction of the guide pin 64 and thus of the sprocket wheel axis 31 by means of journal-bearing bushings 66, 67 inserted into a bore 65. The sprocket wheel 10 comprises a cylindrical flange 68 with a plurality of recesses 72 FIG. 8 on the side thereof facing the slider 62, the recesses serving for a rotation-protected guide of the sliders in the direction of the guide pins 64. A respective guide pin 64 is disposed in each of the recesses 72. By means of this support the individual sliders 62 are rotated together with the sprocket wheel 10. Their distance from the front side thereof, however, is variable by sliding the sliders within the recesses 72 on the guide pins 64.

A cam guide system serves to control the distance of the slider 62 from the sprocket wheel 10, the cam guide system having a cam 69 attached to the slider 62 at the side thereof facing the sprocket wheel axis 31 and engaging with a groove 71 disposed in the peripheral surface of a cam disc 70. The cam disc is supported on the sprocket wheel shaft 34 in a rotation-protected manner by means of the parallel key 35.

Figure 9:
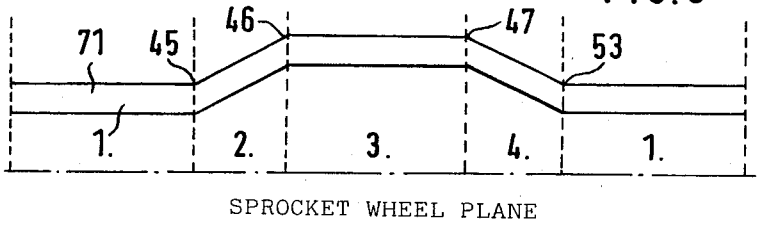
FIG. 9 shows the path of the guiding groove, projected into a plane, of the third embodiment.

The groove 71 extends annularly around the peripheral surface of the cam disc 70 and thus has a constant radial distance from the sprocket wheel axis 31. In axial direction of the cam disc 70 the groove 71 is formed as a curve, i.e. has a distance from the sprocket wheel 10 varying around the cam disc 70. As shown in FIG. 9 the groove 71 has a small first distance from the sprocket wheel 10 in a first section and the distance increases to a second distance in a following second section. In a third section this second distance of the groove is substantially maintained and thereafter again decreases to the first distance in a fourth section. The first section angularly extends from about point 53 to point 45 in FIG. 8, the second section from point 45 to point 46, the third section from point 46 to point 47 and the fourth section from point 47 to point 53.

In operation a clamp 12 engages with a slider 62 at point 44. During the following movement from point 44 to point 45 the cam 69 is guided in the first section of the groove. Thus the movable clamping jaw 151 is vertically lifted off from the fixed clamping jaw 131 until the bolt 152 emerges from the flange sleeve 133. Caused by the increasing distance of the groove 71 from the sprocket wheel 10 from point 45 on the slider 62 is moved away from the sprocket wheel 10 by means of the cam 69 and thus tilts or pivots the movable clamping member 15 around the guide pins 136, 137 such that the movable clamping jaw 151 is pivoted away from the material web and towards the chain, respectively. Thereby the movable clamping member 15 rides on the convex section 42 of the engagement surface 40 in a manner similar to that of the engagement disc 30. The clamp 12 is retained in this position until point 47 is reached. Caused by the decreasing distance of the groove 71 from the sprocket wheel 10 in the angular range between the point 47 and the point 53 the slider 62 is moved back towards the sprocket wheel 10 and the movable clamping member 15 is tilted back into the vertical position. In the following first section of the groove 71 between the points 53 and 54 the slider is held close to the sprocket wheel 10 by means of the groove 71 and the movable clamping jaw 151 is guided back to the fixed clamping jaw 131 vertically with respect thereto.

A predetermined shape of the curve of the groove has been described above as an example. It is the advantage of the third embodiment, however, that the shape of the curve of the groove 71 may be freely selected and hence that the pivoting or tilting, respectively, of the movable clamping member 15 as a function of the angular position of the clamp 12 may be freely controlled by a corresponding design of the groove 71.

By means of the inclined engagement disc 30 or the shape of the annular groove 71, respectively, it is achieved that the movable clamping jaw 151 is first lifted from the fixed clamping jaw 131 in a vertical direction, thereupon swung outwardly or towards the sprocket wheel and away from the material web, respectively, thereafter swung back into a position vertically above the fixed clamping jaw and then vertically lowered thereon. Hence the material web may be easily gripped by the clamp 12 without being pushed to the middle of the packaging machine by the lateral clamps.

Two embodiments of the clamp opening means have been described in connection with the description of the second and third embodiment. As has been shown with the engagement disc in the first embodiment the engagement disc as well as the slider means described in connection with FIGS. 7–9 may be used in connection with any clamp allowing a lifting and pivoting of the movable clamping member.

It should be understood that the above description is in no way limitative and that many modifications and improvements may be brought thereto without departing from the true spirit of the invention.

What is claimed is:

1. Feeding means for feeding a material web from an inlet side to an outlet side in a packaging machine, comprising feeding chains disposed on both sides of the web and sprocket wheels for guiding the feeding chains, each feeding chain having link chains and clamps connected thereto for gripping the edge of the material web, the clamps having a fixed clamping member connected with the associated chain link, a movable clamping member with a clamping jaw and a compression spring for biasing the movable clamping member into the closed position, and further comprising an engagement element for engaging the movable clamping member along a traveling section of the chain where the material web is to be gripped by or released from the clamps, the engagement element being designed as a slider supported slidably in axial direction of the sprocket wheel and engaging with a guiding means extending along the traveling section for guiding the engagement element with a varying distance from the plane of the sprocket wheel while the engagement element moves along the traveling section, whereby in a first portion of the traveling section the movable clamping member is lifted from the fixed clamping member in a substantially vertical direction and in a second portion of the traveling section following the first portion, the clamping jaw of the movable clamping member is additionally moved laterally from the edge of the material web to be gripped.

2. The feeding means of claim 1, wherein the sprocket wheel comprises a cylindrical flange with recesses for guiding the sliders and wherein pins extending into the recesses are provided, a respective slider being supported on every pin.

3. The feeding means of claim 1, wherein a cam disk is provided which is stationarily mounted on a journal of the sprocket wheel and comprises the groove on its peripheral surface.

4. The feeding means of claim 1, wherein the fixed and the movable clamping members each comprise lateral parts, the lateral parts of one clamping member having an oblong hole and the lateral parts of the other clamping member having a bolt type pin guided in the oblong hole.

5. The feeding means of claim 4, wherein the clamp comprises a joint formed by cooperation of the bolt-type guide pins in the lateral parts of the fixed clamping member with the oblong holes in the lateral parts of the movable clamping member.

6. The feeding means of claim 4, wherein a bolt is provided which is rigidly connected with the movable clamping member and which is disposed substantially parallel to the oblong holes and guided in a sleeve cooperating with the fixed clamping member.

7. The feeding means of claim 6, wherein the sleeve is rigidly connected with the fixed clamping member.

8. The feeding means of claim 6, wherein the bolt is emerged from the sleeve in the opened state.

9. The feeding means of claim 6, wherein in a first section of the lifting operation, the movable clamping member is movable only in a plane substantially parallel to the plane of the sprocket wheel and in a following second section may additionally be pivoted with respect to this plane.

10. Feeding means for feeding a material web from an inlet side to an outlet side in a packaging machine, comprising feeding chains disposed on both sides of the web and sprocket wheels for guiding the feeding chains, each feeding chain having chain links and clamps for gripping the material web connected thereto and having a fixed clamping member connected with the associated chain link, a movable clamping member with a clamping jaw and a compression spring for biasing the movable clamping member into the closed position, and further comprising an engagement element adapted to be brought into engagement with the movable clamping member for lifting the movable clamping member from the fixed clamping member along a traveling section of the chain where the material web is to be gripped by or released from the clamps, the engagement element comprising means for guiding the movable clamping member along a curve having a first distance from the plane of the sprocket wheel in a first portion of the traveling section and a second distance from the plane of the sprocket wheel in a second portion of the traveling section following the first portion, whereby in the first portion the movable clamping member is lifted from the fixed clamping member in a substantially vertical direction and in the second portion the clamping jaw of the movable clamping member is additionally moved laterally away from the edge of the material web to be gripped.

* * * * *